US008833003B1

(12) United States Patent
Hohmann, Jr.

(10) Patent No.: US 8,833,003 B1
(45) Date of Patent: Sep. 16, 2014

(54) HIGH-STRENGTH RECTANGULAR WIRE VENEER TIE AND ANCHORING SYSTEMS UTILIZING THE SAME

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/796,754

(22) Filed: Mar. 12, 2013

(51) Int. Cl.
*E04B 1/98* (2006.01)
*E04H 9/02* (2006.01)
*E04B 1/41* (2006.01)

(52) U.S. Cl.
CPC ..... *E04B 1/4178* (2013.01); *E04B 1/98* (2013.01)
USPC ..... 52/167.1

(58) Field of Classification Search
USPC ..... 52/167.1, 698, 699, 700, 703, 704, 708, 52/712, 713, 714, 715
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| 1,794,684 | A | 3/1931 | Handel |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |
| 2,605,867 | A | 8/1952 | Goodwin |
| 2,780,936 | A | 2/1957 | Hillberg |
| 2,929,238 | A | 3/1960 | Kaye |
| 2,966,705 | A | 1/1961 | Massey |
| 2,999,571 | A | 9/1961 | Huber |
| 3,030,670 | A | 4/1962 | Bigelow |
| 3,183,628 | A | 5/1965 | Smith |
| 3,254,736 | A | 6/1966 | Gass |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Mark Wendell
(74) *Attorney, Agent, or Firm* — Silber & Fridman

(57) ABSTRACT

A high-strength rectangular pintle veneer tie and cavity wall anchoring system employing the same is disclosed. The rectangular wire formative construct optionally includes a square cross-section that provides greater volumetric occupancy than that of a similar diameter circular wire formative. The interengaging portions and insertion portion are optionally compressed for greater strength and the rectangular shaped interengaging portion provides a locking interconnection within the anchor precluding significant movement lateral with or normal to the inner wythe.

16 Claims, 6 Drawing Sheets

(56) References Cited

U.S. PATENT DOCUMENTS 3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,478,480 A 11/1969 Swenson
3,563,131 A 2/1971 Ridley, Sr.
3,568,389 A 3/1971 Gulow
3,640,043 A 2/1972 Querfeld et al.
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,305,239 A 12/1981 Geraghty
4,373,314 A 2/1983 Allan
4,382,416 A 5/1983 Kellogg-Smith
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,628,657 A 12/1986 Ermer et al.
4,636,125 A 1/1987 Burgard
4,640,848 A 2/1987 Cerdan-Diaz et al.
4,660,342 A 4/1987 Salisbury
4,703,604 A 11/1987 Muller
4,708,551 A 11/1987 Richter et al.
4,738,070 A 4/1988 Abbott et al.
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,612,343 B2 9/2003 Camberlin et al.
6,627,128 B1 9/2003 Boyer
6,668,505 B1 12/2003 Hohmann et al.
6,686,301 B2 2/2004 Li et al.
6,735,915 B1 5/2004 Johnson, III
6,739,105 B2 5/2004 Fleming
6,789,365 B1 9/2004 Hohmann et al.
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 * 2/2008 Hohmann et al. ..... 52/513
7,334,374 B2 2/2008 Schmid
7,374,825 B2 5/2008 Hazel et al.
7,415,803 B2 8/2008 Bronner
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 6/2010 Massie
7,748,181 B1 7/2010 Guinn
7,788,869 B2 9/2010 Voegele, Jr.
D626,817 S 11/2010 Donowho et al.
7,845,137 B2 12/2010 Hohmann, Jr.
8,037,653 B2 10/2011 Hohmann, Jr.
8,051,619 B2 11/2011 Hohmann, Jr.
8,096,090 B1 1/2012 Hohmann, Jr. et al.
8,109,706 B2 2/2012 Richards
8,122,663 B1 2/2012 Hohmann, Jr. et al.
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,613,175 B2 12/2013 Hohmann, Jr.
2001/0054270 A1 12/2001 Rice
2002/0100239 A1 * 8/2002 Lopez ..... 52/379
2003/0121226 A1 7/2003 Bolduc
2004/0083667 A1 5/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0279043 A1 12/2005 Bronner
2006/0005490 A1 1/2006 Hohmann, Jr.
2006/0198717 A1 9/2006 Fuest
2006/0242921 A1 11/2006 Massie
2006/0251916 A1 11/2006 Arikawa et al.
2008/0092472 A1 4/2008 Doerr et al.
2008/0141605 A1 6/2008 Hohmann
2008/0222992 A1 9/2008 Hikai et al.
2009/0133351 A1 5/2009 Wobber
2009/0133357 A1 5/2009 Richards
2010/0037552 A1 2/2010 Bronner
2010/0071307 A1 3/2010 Hohmann, Jr.
2010/0101175 A1 4/2010 Hohmann
2010/0192495 A1 8/2010 Huff et al.
2010/0257803 A1 10/2010 Hohmann, Jr.
2011/0023748 A1 2/2011 Wagh et al.

(56) References Cited

U.S. PATENT DOCUMENTS

| | | | |
|---|---|---|---|
| 2011/0041442 | A1 | 2/2011 | Bui |
| 2011/0047919 | A1 | 3/2011 | Hohmann, Jr. |
| 2011/0061333 | A1 | 3/2011 | Bronner |
| 2011/0083389 | A1 | 4/2011 | Bui |
| 2011/0146195 | A1 | 6/2011 | Hohmann, Jr. |
| 2011/0173902 | A1 | 7/2011 | Hohmann, Jr. et al. |
| 2011/0277397 | A1 | 11/2011 | Hohmann, Jr. |
| 2012/0186183 | A1 | 7/2012 | Johnson, III |
| 2013/0008121 | A1 | 1/2013 | Dalen |
| 2013/0074435 | A1 | 3/2013 | Hohmann, Jr. |
| 2013/0232893 | A1 | 9/2013 | Hohmann, Jr. |
| 2013/0232909 | A1 | 9/2013 | Curtis et al. |
| 2013/0247482 | A1 | 9/2013 | Hohmann, Jr. |
| 2013/0247483 | A1 | 9/2013 | Hohmann, Jr. |
| 2013/0247484 | A1 | 9/2013 | Hohmann, Jr. |
| 2013/0247498 | A1 | 9/2013 | Hohmann, Jr. |
| 2013/0340378 | A1 | 12/2013 | Hohmann, Jr. |
| 2014/0000211 | A1 | 1/2014 | Hohmann, Jr. |

FOREIGN PATENT DOCUMENTS

| | | | |
|---|---|---|---|
| GB | 1575501 | | 9/1980 |
| GB | 2069024 | A | 8/1981 |
| GB | 2246149 | A | 1/1992 |
| GB | 2265164 | A | 9/1993 |
| GB | 2459936 | B | 3/2013 |

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.

ASTM Standard Specification A951/A951M—11, Table 1, Standard Specification for Steel Wire for Masonry Joint Reinforcement, Nov. 14, 2011, 6 pages, West Conshohocken, Pennsylvania, United States.

Hohmann & Barnard, Inc.; Product Catalog, 2009, 52 pages, Hauppauge, New York, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Product Catalog, 44 pgs (2003).

Kossecka, PH.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

HIGH-STRENGTH RECTANGULAR WIRE VENEER TIE AND ANCHORING SYSTEMS UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, veneer ties with high-strength rectangular wire veneer ties. The veneer ties are for emplacement in the outer wythe and are further accommodated by receptors in the cavity, which receptors extend from the inner wythe to capture the specially configured pintles hereof. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer.

Prior tests have shown that failure of anchoring systems frequently occur at the juncture between the pintle of the veneer tie and the receptor portion of the wall anchor. This invention addresses the need for a high-strength pintle suitable for use with both a masonry block and dry wall construction and provides a strong pintle-to-receptor connection.

Early in the development of high-strength anchoring systems a prior patent, namely U.S. Pat. No. 4,875,319 ('319), to Ronald P. Hohmann, in which a molded plastic clip is described that ties together reinforcing wire and a veneer tie. The assignee of '319, Hohmann & Barnard, Inc., now a MiTek-Berkshire Hathaway company, successfully commercialized the device under the SeismiClip trademark. For many years the white plastic clip tying together the veneer anchor and the reinforcement wire in the outer wythe has been a familiar item in commercial seismic-zone buildings.

Additionally, the high-strength pintle hereof has been combined with the swaged back leg as shown in the inventor's patent, U.S. Pat. No. 7,325,366. The combination item reduces the number of "bits and pieces" brought to the job site and simplifies installation.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same 3/8-inch bed joint height in the inner and outer wythes. Thus, the veneer facing material is tied down over a span of two or more times that which had previously been experienced. Exemplary of the public sector building specification is that of the *Energy Code Requirement*, Boston, Mass. (See Chapter 13 of 780 CMR, Seventh Edition). This Code sets forth insulation R-values well in excess of prior editions and evokes an engineering response opting for thicker insulation and correspondingly larger cavities. The use of the novel rectangular wire veneer tie of the present invention provides a greater volumetric occupancy ratio within the same ⅜-inch bed joint than a corresponding round wire veneer tie. Further, the rectangular veneer tie provides a locking fit within the rounded anchor interconnection location.

The use of wire formatives in cavity wall construction have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block to protect against wythe separation. A balancing of mortar and wire formatives needs to be struck to ensure veneer tie stability within the outer wythe. The present high strength veneer tie greatly assists in maintaining this balance in the mortar joint.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,035,099 | Lapish | Jul. 30, 1991 |
| 5,454,200 | Hohmann | Oct. 3, 1995 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann et al. | Mar. 28, 2006 |
| 7,325,366 | Hohmann, Jr. et al. | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—Schwalberg—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—Hohmann—Issued Jul. 8, 1986

Discloses a dry wall construction system with wallboard attached to the face of studs which, in turn, are attached to an inner masonry wythe. Insulation is disposed between the webs of adjacent studs.

U.S. Pat. No. 4,869,038—Catani—Issued Sep. 26, 1989

Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,875,319—Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,035,099—Lapish—Issued Jul. 30, 1991

Discloses a multi-part wall tie connector for use with cavity walls. The device has a focus on allowing in-plane movement of a veneer. Several components of the system are ductile, allowing the ability to flex back and forth in a bending manner.

U.S. Pat. No. 5,454,200—Hohmann—Issued Oct. 3, 1995

Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003

Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—Hohmann et al.—Issued Sep. 14, 2004

Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005

Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann, et al.—Issued Mar. 28, 2006

Discloses an anchoring system with low-profile wall ties in which insertion portions of the wall anchor and the veneer anchor are compressively reduced in height.

U.S. Pat. No. 7,325,366—Hohmann, Jr. et al.—Issued Feb. 5, 2008

Discloses snap-in veneer ties for a seismic construction system in cooperation with low-profile, high-span wall anchors.

None of the above anchors or anchoring systems provide a veneer tie having a high-strength rectangular veneer tie for fulfilling the need for enhanced compressive and tensile properties and high-strength interconnection. This invention relates to an improved anchoring arrangement for use in conjunction with cavity walls having an inner wythe and an outer wythe and meets the heretofore unmet needs described above.

SUMMARY

In general terms, one embodiment of the invention is a high-strength pintle veneer tie and an anchoring system utilizing the same for cavity walls having an inner and outer wythe. The system includes a rectangular wire-formative veneer tie for emplacement in the outer wythe. The high-strength construction system hereof is applicable to construction of a wall having an inner wythe which, can either be of dry wall construction or masonry block, and an outer wythe, as well as, to insulated and non-insulated structures and high-span construction. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct or directly to a masonry inner wythe), a wire veneer tie, and, optionally, a continuous wire reinforcement is provided. The invention contemplates that the veneer ties are wire formatives with a rectangular cross-section with high-strength pintles depending into the wall cavity for connections between the veneer tie and the wall anchor.

In the embodiments of this invention, the veneer tie is formed from a rectangular wire formative and interconnected within the apertures of the wall anchor. The interconnection restricts movement in the x- and z-axes and maintains a high-strength connection. An alternative design veneer tie has a square cross-section which provides greater volumetric occupancy than a traditional circular wire. The square wire pintles are optionally compressed to increase the tensile and compressive strength of the wire.

The veneer tie is positioned so that the insertion end thereof is embedded in the bed joint of the outer wythe. The construction of the veneer tie results in an orientation upon emplacement so that the widest part of the pintle is subjected to compressive and tensile forces. The insertion end of the veneer tie is optionally compressed to provide a high strength connection within the bed joint and is positioned on the outer wythe so that a continuous reinforcement wire can be snapped into and secured to the outer wythe. The snap-in feature of the anchor here replaces the traditional function of the seismic clip for accommodating a straight wire run (see U.S. Pat. No. 4,875,319) and receiving the open end of the box tie.

It is an object of the present invention to provide in an anchoring system having an outer wythe and an inner wythe, a high-strength veneer tie that interengages a wall anchor which system further includes a rectangular wire veneer tie.

It is another object of the present invention to provide labor-saving devices to simplify seismic and nonseismic high-strength installations of brick and stone veneer and the securement thereof to an inner wythe.

It is yet another object of the present invention to provide a veneer tie that increases volumetric occupancy in the bed joint.

It is a further object of the present invention to provide an anchoring system for cavity walls comprising a limited number of component parts that are economical of manufacture resulting in a relatively low unit cost.

It is yet another object of the present invention to provide an anchoring system which restricts lateral and horizontal movements of the facing wythe with respect to the inner wythe, but is adjustable vertically.

It is a feature of the present invention that the veneer tie, after being inserted into the receptors therefor, pintles are oriented so that the widest portion thereof is subjected to compressive to tensile forces.

It is another feature of the present invention that the veneer ties are utilizable with either a masonry block having aligned or unaligned bed joints and for a dry wall construct that secures to a metal stud.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
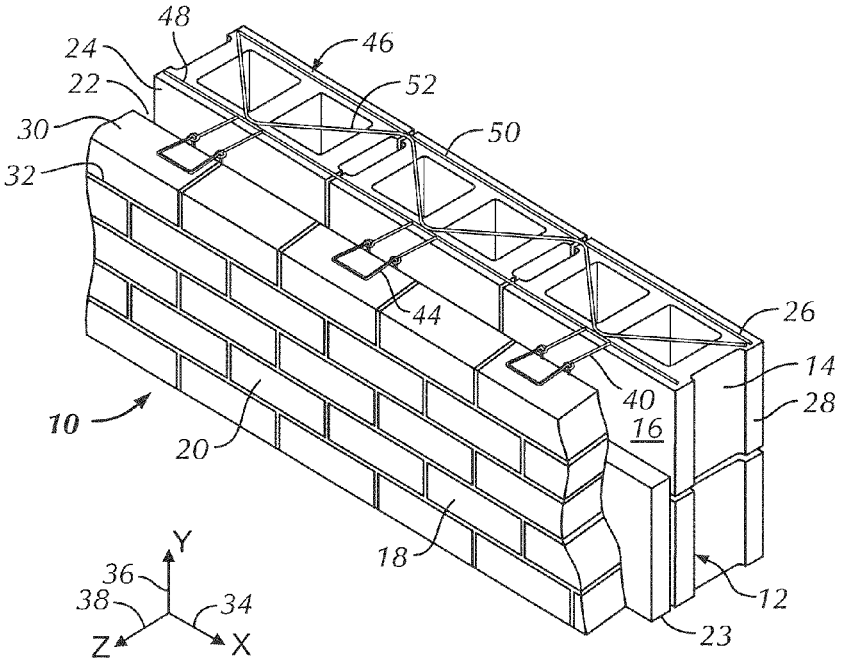
FIG. 1 is a perspective view of a first embodiment of an anchoring system having a high-strength rectangular veneer tie of this invention and side-welded, wall anchor and shows a wall with an inner wythe of masonry block and an outer wythe of brick veneer.

In the embodiments described herein the veneer ties are formed from high-strength rectangular wire formatives which provide a greater volumetric occupancy ratio within the same ⅜-inch bed joint than a than that of a corresponding traditional cylindrical wire formative. The use of a rectangular wire provides a locking fit within the rounded anchor interconnection area. The use of a rectangular wire within the circular enclosure restricts movement along the x- and z-axes.

Before proceeding to the detailed description, the following definitions are provided. For purposes of defining the invention at hand, compression of the wire formative occurs through cold working so that the resultant body is substantially semicircular at the edges and has flat surfaces therebetween. In use, the rounded edges are aligned so as to receive compressive forces transmitted from the veneer or outer wythe, which forces are generally normal to the facial plane thereof. In the discussion that follows the width of the compressed interconnecting portion is also referred to as the major axis and the thickness is referred to as the minor axis.

As the compressive forces are exerted on the edges of the compressed portions, it withstands forces greater than uncompressed wire formatives formed from the same gage wire. Information reflecting the enhancement represented by the cold-worked wire formatives is included hereinbelow.

In accordance, with the *Building Code Requirements for Masonry Structures, ACI* 530-05/*ASCE* 5-05/*TMS* 402-05, Chapter 6, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

The description which follows is of three embodiments of anchoring systems utilizing the pintle veneer tie devices of this invention, which devices are suitable for nonseismic and seismic cavity wall applications. Two of the embodiments apply to cavity walls with masonry block inner wythes, and the remaining embodiment to a cavity wall with a dry wall (sheetrock) inner wythe. The wall anchor of the first embodiment is adapted from that shown in U.S. Pat. No. 6,789,365 of the inventors hereof Referring now to FIGS. 1 through 4 and 9 the first embodiment of the anchoring system hereof including a high-strength veneer tie of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from surface 24 of backup wall 14 and optionally contains insulation 23.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint 26 and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 10 includes a wall anchor 40 constructed for embedment in bed joint 26, which, in turn, includes a free end with one or more receptor portions 58 having two legs or traverse wire member 54 extending into cavity 22. Further, the device 10 includes a wire formative veneer tie or anchor 44 for embedment in bed joint 30.

The wall anchor 40 is shown in FIG. 1 as being emplaced on a course of blocks 16 in preparation for embedment in the mortar of bed joint 26. In the best mode of practicing this embodiment, a truss-type wall reinforcement wire portion 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming the truss structure 46. Alternatively, a ladder-type wall reinforcement as shown in FIG. 8 is applicable to the present invention.

Figure 8:
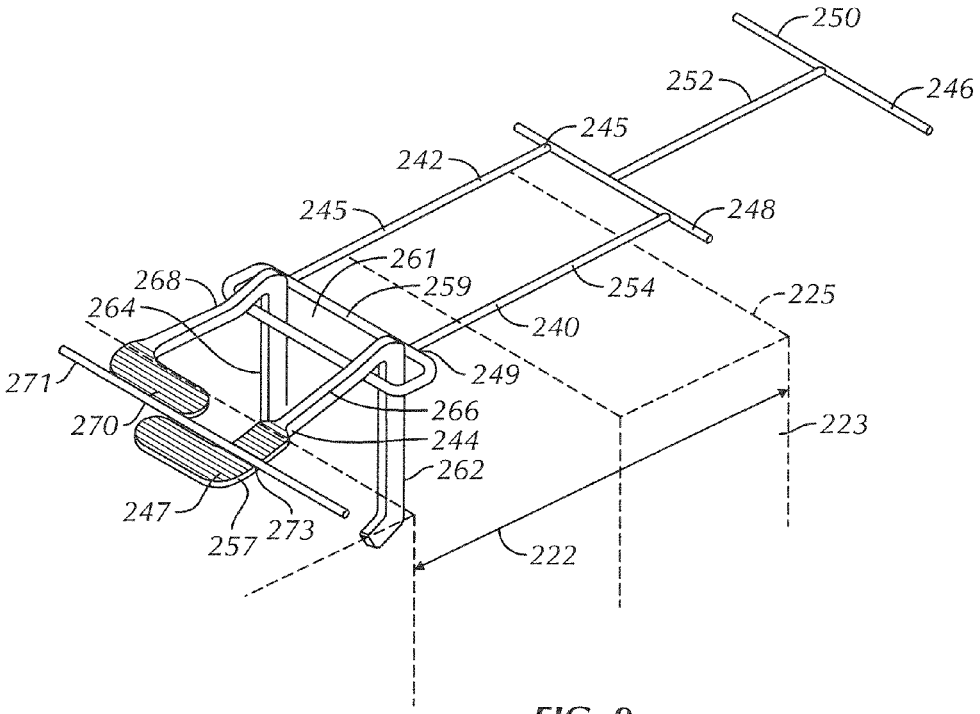
FIG. 8 is a perspective view of a third embodiment of an anchoring system having a veneer tie with high-strength rectangular pintles of this invention and a side-welded, wall anchor and shows a wall with a high-span cavity to accommodate increased insulation with a compressed veneer tie insertion portion and a reinforcement wire set therewithin; and, FIG. 9 is a cross-sectional view of a circular wire formative veneer tie and a rectangular wire formative veneer tie having the same diameter and sets forth the respective volumetric occupancy rates.

At intervals along the wall reinforcement 46, spaced pairs of transverse wire members or legs 54 are attached thereto and are attached to each other by a rear leg 56 therebetween or directly to the straight wire member as shown in FIG. 8. These pairs of wire members 54 extend into cavity 22 to veneer tie 44. As will become clear by the description which follows, the spacing between the transverse wire members 54 is constructed to limit the x-axis movement of the construct. Each transverse wire member 54 has at the end opposite the attachment end an eyelet or receptor portion 58 formed contiguously therewith.

Upon installation, the eye or aperture 60 of receptor portion 58 is constructed to be within a substantially horizontal plane normal to exterior surface 24. The aperture 60 is dimensioned to accept a pintle of the veneer tie or anchor 44 therethrough and has a slightly larger opening than that required to accommodate the pintle. This relationship minimizes the movement of the construct in along a z-vector and in an xz-plane. For positive engagement, the aperture 60 of receptor portion 58 is sealed forming a closed loop. Alternatively, a single eyelet 259 with a substantially oval opening 261, as shown in FIG. 8, is used. The single eyelet 259 is welded closed.

The veneer tie 44 is, when viewed from a top or bottom elevation, generally U-shaped and is dimensioned to be accommodated by the pair of eye wires 58 or a single eyelet 259 previously described. The tie 44 is a wire formative with a substantially rectangular cross-section and has two interengaging end portions or pintles 62 and 64, two side cavity portions 66 and 68, and an insertion end portion 70. As more clearly seen in FIGS. 3 and 4, the rectangular pintles 62, when viewed as installed, have a cross-section taking in a horizontal or an xz-plane that includes the longitudinal axis of the receptor 58 and shows the greatest dimension 61 substantially oriented along a z-vector. Similarly, when viewed as installed, the pintle cross-section taking in a vertical plane that includes the longitudinal axis of the wire member 54 shows the major axis dimension 61 substantially oriented along a z-vector.

Figure 2:
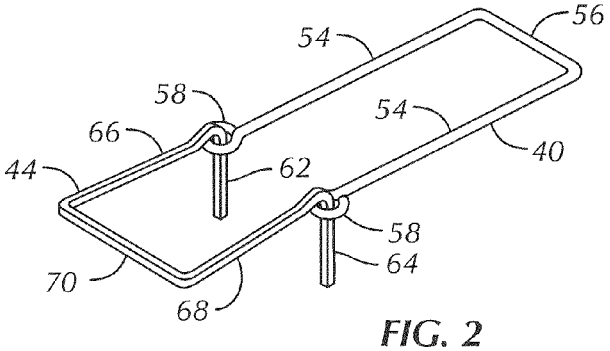
FIG. 2 is a perspective view of the veneer tie and anchor of FIG. 1 showing details of the wall anchor and the rectangular veneer tie.
Figure 3:
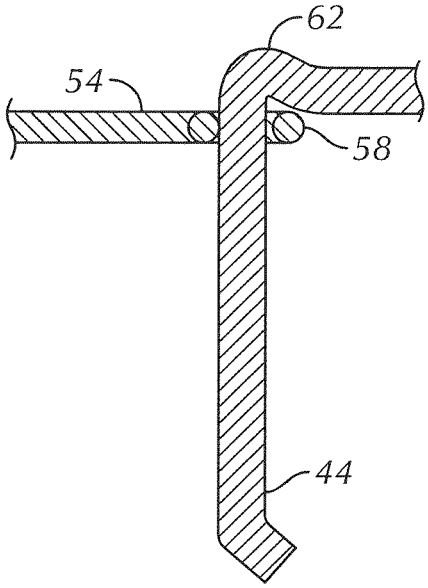
FIG. 3 is a partial cross-sectional view of the anchoring system of FIG. 2 on a substantially vertical plane showing the receptor portion of the wall anchor and the pintle of the veneer tie.
Figure 4:
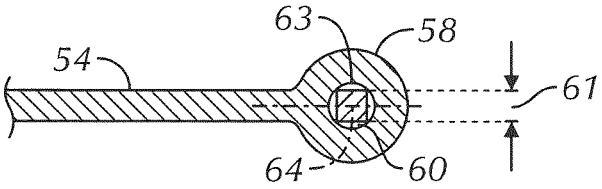
FIG. 4 is a partial cross-sectional view of the anchoring system of FIG. 2 on a substantially horizontal plane showing the receptor portion of the wall anchor and the pintle of the veneer tie.
Figure 6:
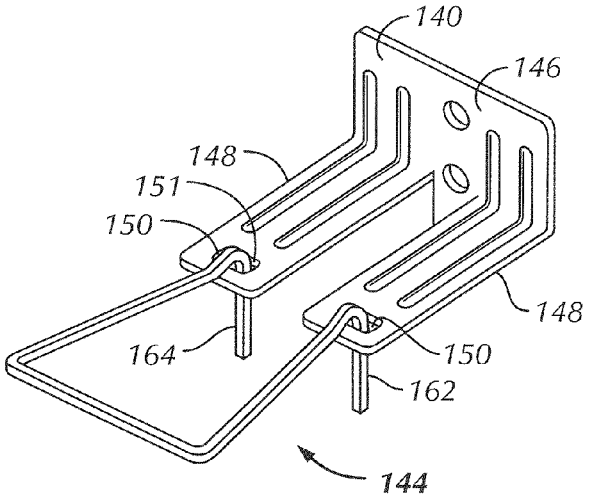
FIG. 6 is a perspective view of the anchor and veneer ties of FIG. 5 showing the details of the rectangular veneer tie and anchor.
Figure 5:
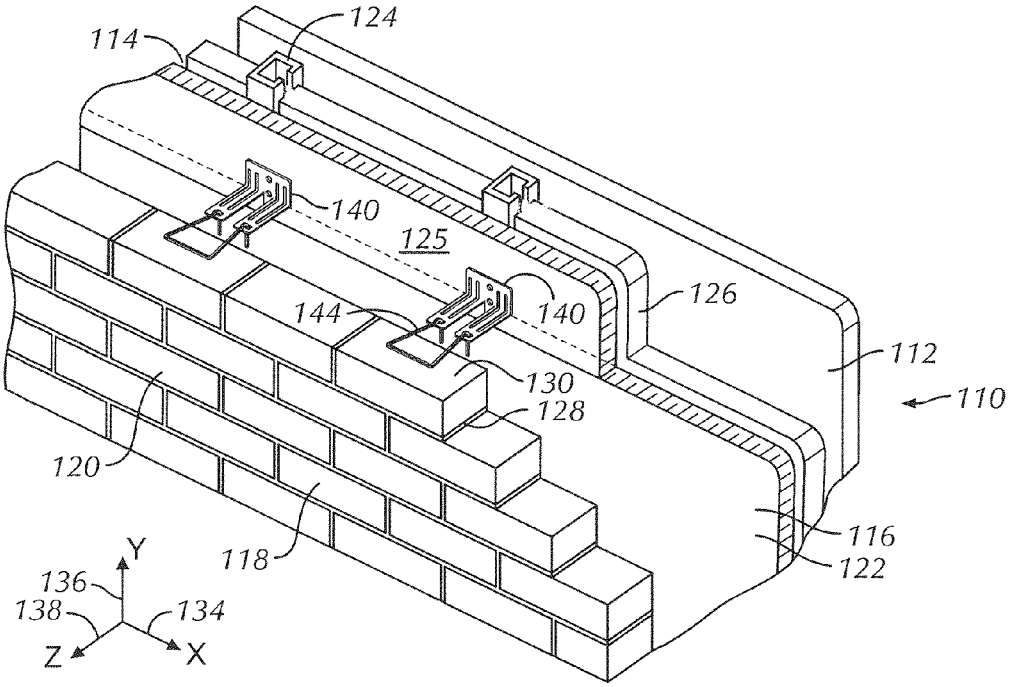
FIG. 5 is a perspective view of a second embodiment of an anchoring system having a veneer tie with high-strength rectangular pintles of this invention, wherein the building system therefor includes a sheetmetal anchor for a drywall inner wythe.
Figure 7:
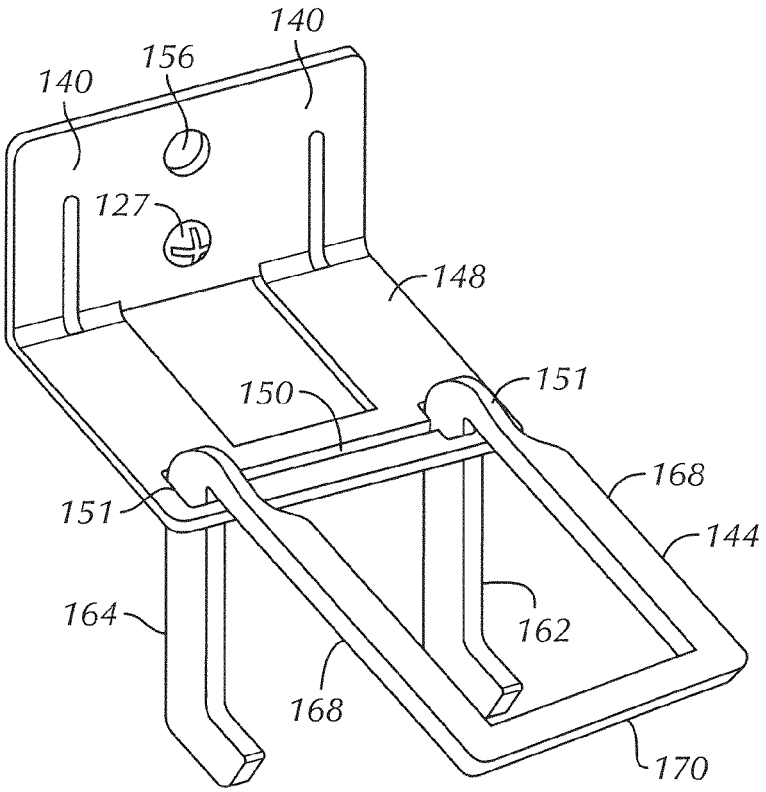
FIG. 7 is a perspective view of the veneer tie of FIG. 5 set within an alternative design anchor and having the interconnecting portions compressively reduced.
Figure 9:
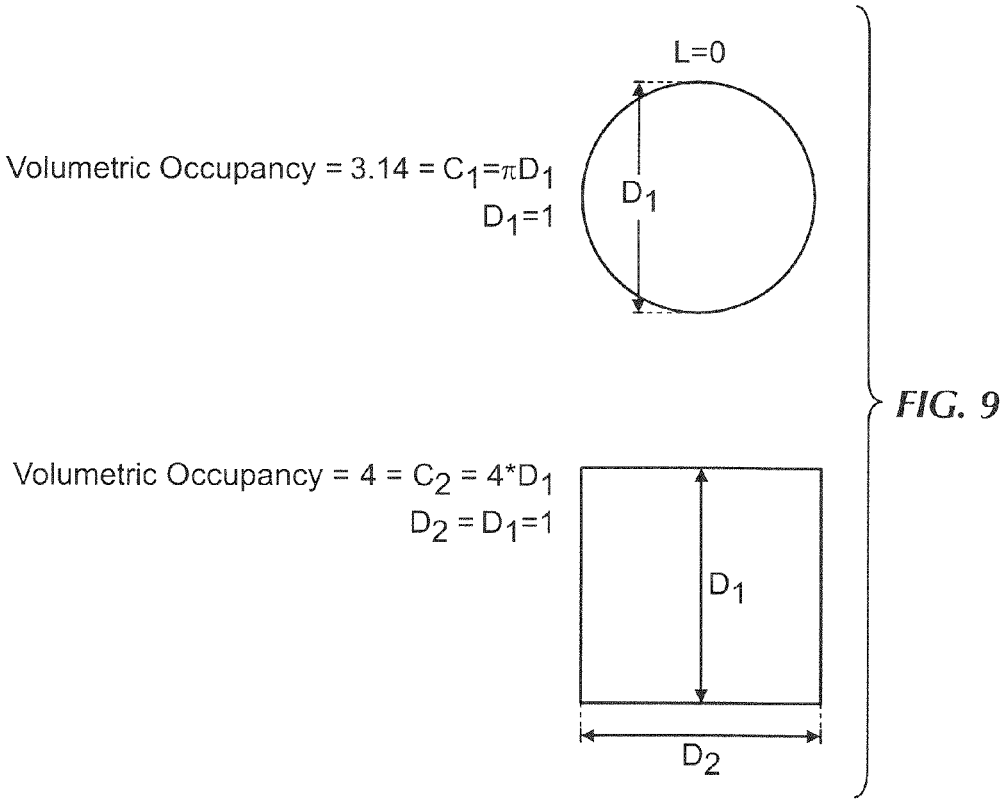

The cross-sectional illustrations show the manner in which wythe-to-wythe and side-to-side movement is limited by the close fitting relationship between the pintles and the receptor openings. Alternatively, a veneer tie 144 with a substantially square cross-section, as shown in FIG. 6, is interchangeable with the veneer tie 44. The veneer tie 144 interengaging end portions 162, 164 are optionally compressed to a form similar to that of the rectangular shaped veneer tie 44 interengaging end portions 62, 64 as shown in FIGS. 2 through 4 thereby increasing tension and compression ratings of the wire formative. A veneer tie 144 with a substantially square cross-section, as shown in FIG. 9, a 27% higher volumetric occupancy rate than that of a round wire having the same diameter thereby providing a stronger interconnection with the outer wythe 12.

The veneer tie insertion portion is optionally compressively reduced as shown in FIG. 8. The tie 244 has an insertion portion 270 that is compressibly deformed and has a pattern 247 of recessed areas or corrugations 257 impressed thereon for receiving mortar within the recessed areas 257. The insertion portion 270 is configured to maximize surface contact with the mortar in the bed joint 30. The insertion portion 270 of the veneer tie 244 is a wire formative formed from a wire having a diameter substantially equal to the predetermined height of the mortar joint. Upon compressible reduction in height, the insertion portion 270 is mounted upon the exterior wythe and positioned to receive mortar thereabout. The insertion portion 270 retains the mass and substantially the tensile strength as prior to deformation. The vertical height of the insertion portion 270 is reduced so that, upon installation, mortar of bed joint 30 flows around the insertion portion 270.

Upon compression, a pattern or corrugation 257 is impressed on insertion portion 270 and, upon the mortar of bed joint 30 flowing around the insertion portion 270, the mortar flows into the corrugation 257. For enhanced holding, the corrugations 257 are, upon installation, substantially parallel to x-axis 34. In this embodiment, the pattern 247 is shown impressed on only one side thereof; however, it is within the contemplation of this disclosure that corrugations or other patterning could be impressed on other surfaces of the insertion portion 270. Other patterns such as a waffle-like, cellular structure and similar structures optionally replace the corrugations. With the veneer tie 244 constructed as described, the veneer tie 244 is characterized by maintaining substantially all the tensile strength as prior to compression while acquiring a desired low profile.

The insertion portion 270 is optionally configured (as shown in FIG. 8) to accommodate therewithin a reinforcement wire or straight wire member 271 of predetermined diameter. The insertion portion 270 has a compression 273 dimensioned to interlock with the reinforcement wire 271. With this configuration, the bed joint height specification is readily maintained and the reinforcing wire 271 interlocks with the veneer tie 244 within the 0.300-inch tolerance, thereby forming a seismic construct.

The description which follows is of a second embodiment of the high-strength anchoring system. For ease of comprehension, where similar parts are used reference designators "100" units higher are employed. Thus, the veneer tie 144 of the second embodiment is analogous to the veneer tie 44 of the first embodiment.

Referring now to FIGS. 3 through 7 and 9, the second embodiment of the high-strength anchoring system is shown and is referred to generally by the numeral 110. The system 110 employs a sheetmetal wall anchor 140. The dry wall structure 112 is shown having an interior wythe 114 with wallboard 116 as the interior and exterior facings thereof. An exterior or outer wythe 118 of facing brick 120 is attached to dry wall structure 112 and a cavity 122 is formed therebetween. The dry wall structure 112 is constructed to include, besides the wallboard facings 116, vertical channels 124 with insulation layers 126 disposed between adjacent channel members 124. Selected bed joints 128 and 130 are constructed to be in cooperative functional relationship with the veneer tie described in more detail below.

For purposes of discussion, the exterior surface 125 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a dry wall anchor 140 constructed for attachment to vertical channel members 124, for embedment in joint 130 and for interconnecting with the veneer tie 144.

Reference is now directed to the L-shaped, surface-mounted sheetmetal bracket or wall anchor 140 comprising a mounting portion or base plate member 146 and free end projecting or extending portion 148 into the cavity 122. The projecting or extending portion(s) 148 is contiguous with the base plate member 146 so as to have, upon installation, a horizontally disposed elongated aperture 150 which provides for wire-tie-receiving receptors 151. The aperture 150 is formed in plate member 146. Alternatively, Upon installation, the projecting portion 148 is thus disposed substantially at right angles with respect to the plate member 146. To ease tolerance, receptors 151 may be slightly elongated along the x-axis thereof. The plate member 146 is also provided with mounting holes 156 at the upper and lower ends thereof. The interengaging end portions 162, 164 are dimensioned to be secured within the aperture(s) 150, 151.

The projecting portion 148 is spaced from the plate member 146 and adapted to receive the interengaging end portions 162, 164 of veneer tie 144 therewithin. In the fabrication of the dry wall as the inner wythe of this construction system 110, the channel members 124 are initially secured in place. In this regard, the channel members 124 may also comprise the standard framing member of a building. Sheets of exterior wallboard 116, which may be of an exterior grade gypsum board, are positioned in abutting relationship with the forward flange of the channel member 124. While the insulating layer 126 is shown as panels dimensioned for use between adjacent column 124, it is to be noted that any similarly suited rigid or flexible insulating material may be used herein with substantially equal efficacy.

After the initial placement of the flexible insulation layer 126 and the wallboard 116, the veneer anchors 140 are secured to the surface of the wallboard 116 in front of channel members 124. Thereafter, sheetmetal screws 127 are inserted into the mounting holes 156 to fasten the anchor 140 to the channel member 124.

The veneer tie 144 is, when viewed from a top or bottom elevation, generally U-shaped and is dimensioned to be accommodated by the wall anchor 140. The tie 144 is a wire formative with a substantially square cross-section and has two interengaging end portions or pintles 162 and 164, two side cavity portions 166 and 168, and an insertion end portion 170. Alternatively, a veneer tie 44 with a substantially rectangular cross-section, as shown in FIG. 2, is interchangeable with the veneer tie 144. The veneer tie 144 interengaging end portions 162, 164 are optionally compressed to a form similar to that of the rectangular shaped veneer tie 44 interengaging end portions 62, 64 as shown in FIGS. 2 through 4, thereby increasing tension and compression ratings of the wire formative. A veneer tie 144 with a substantially square cross-section provides, as shown in FIG. 9, a 27% higher volumetric occupancy rate than that of a round wire having the same diameter, thereby providing a stronger interconnection with the outer wythe 118. As more clearly seen in FIG. 7, the pintles 162, 164 when compressed and viewed as installed, have a cross-section taking in a horizontal or an xz-plane that includes the longitudinal axis of the receptor and shows the greatest dimension substantially oriented along a z-vector.

The veneer tie insertion portion is optionally compressively reduced as shown in FIG. 8. The tie has an insertion portion 270 that is compressibly deformed and has a pattern 247 of recessed areas or corrugations 257 impressed thereon for receiving mortar within the recessed areas 257. The insertion portion 270 is configured to maximize surface contact with the mortar in the bed joint 30. The insertion portion 270 of the veneer tie 244 is a wire formative formed from a wire having a diameter substantially equal to the predetermined height of the mortar joint. Upon compressible reduction in height, the insertion portion 270 is mounted upon the exterior wythe and positioned to receive mortar thereabout. The insertion portion 270 retains the mass and substantially the tensile strength as prior to deformation. The vertical height of the insertion portion 270 is reduced so that, upon installation, mortar of bed joint 130 flows around the insertion portion 270.

Upon compression, a pattern or corrugation 257 is impressed on insertion portion 270 and, upon the mortar of bed joint 130 flowing around the insertion portion 270, the mortar flows into the corrugation 257. For enhanced holding, the corrugations 257 are, upon installation, substantially parallel to the x-axis 134. In this embodiment, the pattern 247 is shown impressed on only one side thereof; however, it is within the contemplation of this disclosure that corrugations or other patterning could be impressed on other surfaces of the insertion portion 270. Other patterns such as a waffle-like, cellular structure and similar structures optionally replace the corrugations. With the veneer tie 244 constructed as described, the veneer tie 244 is characterized by maintaining substantially all the tensile strength as prior to compression while acquiring a desired low profile.

The insertion portion 270 is optionally configured (as shown in FIG. 8) to accommodate therewithin a reinforcement wire or straight wire member 271 of predetermined diameter. The insertion portion 270 has a compression 273 dimensioned to interlock with the reinforcement wire 271. With this configuration, the bed joint height specification is readily maintained and the reinforcing wire 271 interlocks with the veneer tie 244 within the 0.300-inch tolerance, thereby forming a seismic construct.

The description which follows is of a third embodiment of the high-strength pintle anchoring system. In this embodiment, the wall anchor portion is adapted from the high-span anchor and wall reinforcement device of U.S. Pat. No. 6,668,505 to Hohmann, et al. For ease of comprehension, where similar parts are shown, reference designators "200" units higher than those previously employed are used. Thus, the veneer tie 244 of the third embodiment is analogous to the veneer tie 44 of the first embodiment. Referring now to FIGS. 8 and 9, the third embodiment of a high-strength pintle anchoring system of this invention is shown and is referred to generally by the numerals 240 for the wall anchor, 244 for the veneer tie, and 246 for the backup wall reinforcement. As this embodiment is similar to the first embodiment, the wall structure is partially shown, but the wall structure of FIG. 1 is incorporated herein by reference.

The backup wall is insulated with strips of insulation 223 attached to the cavity surface of the backup wall and has seams 225 between adjacent strips coplanar with adjacent bed joints. In this embodiment, the cavity 222 is larger-than-normal and has a 5-inch span.

The wall anchor 240 is shown in FIG. 8 and has a free end or extension 242 that spans the insulation and cavity for interconnection with veneer tie 244. In this embodiment, a ladder-type wall reinforcement 246 is constructed of a wire formative with two parallel continuous straight side wire members 248 and 250 spaced so as, upon installation, to each be centered along the outer walls of the masonry blocks. An intermediate wire body 252 is interposed therebetween and is butt welded to wire members 248 and 250, or electric resistance welded in accord with *ASTM Standard Specification A*951. A wall anchor 240 is fusibly attached at an attachment end 245 to the wall reinforcement 248. The wall reinforcement 248 has an upper surface in one plane and a lower surface in a plane substantially parallel thereto. The wall anchor 240 extends between the plane of the upper surface and the plane of the lower surface from an attachment end 245, which is fusibly attached, to the vertical surface of the backup wall.

Pairs of wire members or extended leg portions 254 extend into the cavity 222 and have a free end 249 opposite the attachment end 245 and receptor portions 259 (single as shown in FIG. 8 or in the alternative two receptor portions 58 as shown in FIG. 2) contiguous therewith. The spacing therebetween limits the x-axis movement of the construct. Each receptor portion 259 has an eyelet or receptor opening 261 formed continuous therewith. Upon installation, the receptor opening 261 is constructed to be within a substantially horizontal or xz-plane, which is normal to the cavity walls. The receptor portion 259 is horizontally aligned to accept the interengaging end portion 262, 264 of veneer tie 244 threaded therethrough. The receptor openings 261 are slightly greater than the width or major axis of the interengaging end portion 262, 264 and the interengaging end portion fits snugly therewithin. These dimensional relationships minimize the x- and z-axis movement of the construct.

The veneer tie 244 is, when viewed from a top or bottom elevation, generally U-shaped and is dimensioned to be accommodated by the pair of eyelets 58 or a single eyelet 259 previously described. The tie 244 is wire formative with a substantially rectangular cross-section and has two interengaging end portions or pintles 262 and 264, two side cavity portions 266 and 268, and an insertion end portion 270.

The cross-sectional illustrations show the manner in which wythe-to-wythe and side-to-side movement is limited by the close fitting relationship between the pintles and the receptor openings. Alternatively, a veneer tie 144 with a substantially square cross-section, as shown in FIG. 6, is interchangeable with the veneer tie 244. A veneer tie 144 with a substantially square cross-section, as shown in FIG. 9, a 27% higher volumetric occupancy rate than that of a round wire having the same diameter thereby providing a stronger interconnection with the outer wythe 118.

The veneer tie insertion portion is optionally compressively reduced as shown in FIG. 8. The tie has an insertion portion 270 that is compressibly deformed and has a pattern 247 of recessed areas or corrugations 257 impressed thereon for receiving mortar within the recessed areas 257. The insertion portion 270 is configured to maximize surface contact with the mortar in the bed joint 230. The insertion portion 270 of the veneer tie 244 is a wire formative formed from a wire having a diameter substantially equal to the predetermined height of the mortar joint. Upon compressible reduction in height, the insertion portion 270 is mounted upon the exterior wythe and positioned to receive mortar thereabout. The insertion portion 270 retains the mass and substantially the tensile strength as prior to deformation. The vertical height of the insertion portion 270 is reduced so that, upon installation, mortar of bed joint 230 flows around the insertion portion 270.

Upon compression, a pattern or corrugation 257 is impressed on insertion portion 270 and, upon the mortar of bed joint 230 flowing around the insertion portion 270, the mortar flows into the corrugation 257. For enhanced holding, the corrugations 257 are, upon installation, substantially parallel to x-axis 234. In this embodiment, the pattern 247 is shown impressed on only one side thereof; however, it is within the contemplation of this disclosure that corrugations or other patterning could be impressed on other surfaces of the insertion portion 270. Other patterns such as a waffle-like, cellular structure and similar structures optionally replace the corrugations. With the veneer tie 244 constructed as described, the veneer tie 244 is characterized by maintaining substantially all the tensile strength as prior to compression while acquiring a desired low profile.

The insertion portion 270 is optionally configured (as shown in FIG. 8) to accommodate therewithin a reinforcement wire or straight wire member 271 of predetermined diameter. The insertion portion 270 has a compression 273 dimensioned to interlock with the reinforcement wire 271. With this configuration, the bed joint height specification is readily maintained and the reinforcing wire 271 interlocks with the veneer tie 244 within the 0.300-inch tolerance, thereby forming a seismic construct.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor fixedly attached to said inner wythe and having a free end thereof extending into said cavity, said free end of said wall anchor comprising:

one or more receptor portions disposed in said cavity, said one or more receptor portions being openings disposed substantially horizontal, said one or more receptor portions comprising two eyelets disposed substantially horizontal in said cavity and spaced apart at a predetermined interval, each of said two eyelets being welded closed and having a substantially circular opening therethrough with a predetermined diameter; and, a wire-formative veneer tie having a substantially rectangular cross-section, said veneer tie having height and width dimensions which are substantially equivalent forming a substantially square cross section, said veneer tie further comprising:

an insertion end portion for disposition in said bed joint of said outer wythe, said insertion end portion having a 27% higher volumetric occupancy than that of a round wire having a diameter substantially equal to the height and width of the veneer tie;

one or more cavity portions for disposition in said cavity, said cavity portions contiguous with said insertion end portion; and, one or more interengaging end portions for disposition into said one or more receptor portions of said wall anchor, each said interengaging end portion being dimensioned to be secured within one of said two eyelets, each said interengaging end portion contiguous with said cavity portions and set opposite said insertion end portion, each said interengaging end portion comprising a pintle having a free end, each pintle having a substantially rectangular cross-section.

2. A high-strength pintle anchoring system as described in claim 1 wherein said one or more receptor portions further comprise a single eyelet with a substantially oval opening therethrough, said single eyelet being welded closed; and, each said interengaging end portion is dimensioned to be secured within said single eyelet.

3. A high-strength pintle anchoring system as described in claim 1 wherein said insertion portion is compressively reduced.

4. A high-strength pintle anchoring system as described in claim 3 wherein said veneer tie insertion portion further comprises:

a compression dimensioned to interlock with a reinforcement wire; and, a reinforcement wire disposed in said compression;

whereby upon insertion of said reinforcement wire in said compression a seismic construct is formed.

5. A high-strength pintle anchoring system as described in claim 1 wherein said one or more interengaging end portions are compressively reduced in thickness thereby increasing the tension and compression rating of the wire formative.

6. A high-strength pintle anchoring system as described in claim 1 wherein said inner wythe is formed from successive courses of masonry block with a bed joint of predetermined height between each two adjacent courses, said inner wythe having a reinforcement ladder or truss in said bed joint, said wall anchor further comprising:

a wire formative fixedly attached to said reinforcement having at least two legs extending into and terminating within said cavity; and, wherein the major cross-sectional axis of each said interengaging end portions is substantially parallel to the longitudinal axes of said legs of said wall anchor.

7. A high-strength pintle anchoring system as described in claim 1 wherein said inner wythe is a dry wall structure having wallboard panels mounted on columns or framing members, said wall anchor further comprising:

a surface-mounted sheetmetal bracket fixedly attached to said columns of said inner wythe, said sheetmetal bracket being L-shaped and having a mounting portion and an extending portion for extending substantially horizontally into said cavity, said extending portion with said one or more receptor portions therethrough; and, wherein the major cross-sectional axis of each of said interengaging end portion is substantially normal to said wallboard panels.

8. A high-strength pintle anchoring system as described in claim 7 wherein said one or more receptor portions further comprise two apertures disposed substantially horizontal in said cavity and spaced apart at a predetermined interval; and, wherein each of said two apertures are shaped substantially similar to the cross section of each of said interengaging end portions and said interengaging end portions are dimensioned to be secured within one of said openings of said two apertures.

9. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said inner wythe being a dry wall structure having wallboard panels mounted on columns or framing members, said system comprising:

a wall anchor fixedly attached to said inner wythe and having a free end thereof extending into said cavity, said free end of said wall anchor comprising one or more receptor portions disposed in said cavity, said one or more receptor portions being openings disposed substantially horizontal, said wall anchor being a surface-mounted sheetmetal bracket fixedly attached to said columns of said inner wythe, said sheetmetal bracket being L-shaped and having a mounting portion and an extending portion for extending substantially horizontally into said cavity, said extending portion with said one or more receptor portions therethrough; and, a wire-formative veneer tie having a substantially rectangular cross-section, said veneer tie further comprising:

an insertion end portion for disposition in said bed joint of said outer wythe;

one or more cavity portions for disposition in said cavity, said cavity portions contiguous with said insertion end portion; and, one or more interengaging end portions for disposition into said one or more receptor portions of said wall anchor, each said interengaging end portion contiguous with said cavity portions and set opposite said insertion end portion, wherein said one or more receptor portions further comprise a single eyelet with a substantially oval opening therethrough, said single eyelet being welded closed; and, each said interengaging end portion is dimensioned to securely interlock within said single eyelet.

10. A high-strength pintle anchoring system as described in claim 9 wherein said wire formative veneer tie has a 27% higher volumetric occupancy than that of a round wire having a diameter substantially equal to the lesser of a height and a width of the veneer tie in cross section.

11. A high-strength pintle anchoring system for use in a cavity wall formed from a backup wall and a facing wall in a spaced apart relationship with a vertical surface of the backup wall forming one side of a cavity therebetween, said cavity in excess of four inches, said backup wall formed from a plurality of successive courses of masonry block with a bed joint of predetermined height between each two adjacent courses, said high-span anchor and reinforcement device comprising, in combination:

a wall reinforcement with an upper surface in one plane and a lower surface in a plane substantially parallel thereto, said wall reinforcement adapted for mounting in said bed joint of said backup wall;

at least one wall anchor fusibly attached at an attachment end thereof to said wall reinforcement, and, upon installation in said bed joint of said backup wall, extending between said plane of said upper surface and said plane of said lower surface from an attachment end thereof to the vertical surface of said backup wall; said wall anchor, in turn, comprising:

at least one extended leg portion for spanning said cavity, said extended leg portion having a free end contiguous therewith, opposite said attachment end, and having one or more receptor portions therein; and, a wire-formative veneer tie having a substantially rectangular cross-section, said veneer tie further comprising:

an insertion end portion for disposition in said bed joint of said outer wythe;

two cavity portions for disposition in said cavity, said cavity portions contiguous with said insertion end portion; and, two interengaging end portions for disposition into said one or more receptor portions of said wall anchor, said interengaging end portions contiguous with said cavity portions and set opposite said insertion end portion.

12. A high-strength pintle anchoring system as described in claim 11 wherein said wall anchor has two extended leg portions each having a receptor portion, said receptor portions further comprising two eyelets disposed substantially horizontal in said cavity and spaced apart at a predetermined interval; and, wherein said interengaging end portions are dimensioned to be secured within said eyelets.

13. A high-strength pintle anchoring system as described in claim 12 wherein the major cross-sectional axes of said interengaging end portions are substantially parallel to the longitudinal axes of said leg portions of said wall anchor.

14. A high-strength pintle anchoring system as described in claim 13 wherein said wire formative veneer tie has height and width dimensions which are substantially equivalent forming a substantially square cross-section; and, said interengaging end portions are compressively reduced.

15. A high-strength pintle anchoring system as described in claim 14, wherein said veneer tie has a 27% higher volumetric occupancy than that of a round wire having a diameter substantially equal to the height and width of the veneer tie.

16. A high-strength pintle anchoring system as described in claim 13, wherein said insertion portion is compressively reduced, said insertion portion further comprising:

a compression dimensioned to interlock with a reinforcement wire; and a reinforcement wire disposed in said compression;

whereby upon insertion of said reinforcement wire in said compression a seismic construct is formed.

* * * * *